US011952761B1

(12) United States Patent
Ganim

(10) Patent No.: US 11,952,761 B1
(45) Date of Patent: Apr. 9, 2024

(54) BATHTUB SAFETY DEVICE

(71) Applicant: Yasein Ganim, Westlake, OH (US)

(72) Inventor: Yasein Ganim, Westlake, OH (US)

( * ) Notice: Subject to any disclaimer, the term of this patent is extended or adjusted under 35 U.S.C. 154(b) by 230 days.

(21) Appl. No.: 17/215,175

(22) Filed: Mar. 29, 2021

Related U.S. Application Data

(60) Provisional application No. 63/003,642, filed on Apr. 1, 2020.

(51) Int. Cl.
*E03C 1/244* (2006.01)

(52) U.S. Cl.
CPC ..... *E03C 1/244* (2013.01)

(58) Field of Classification Search
CPC ..... E03C 1/244
USPC ..... 4/680, 686, 687; D23/261
See application file for complete search history.

(56) References Cited

U.S. PATENT DOCUMENTS

| | | | | |
|---|---|---|---|---|
| 1,820,981 | A | | 9/1931 | LeFever |
| 2,120,179 | A | | 6/1938 | Heckert |
| 2,180,790 | A | | 11/1939 | Brummet |
| D138,613 | S | | 8/1944 | Patten |
| D156,391 | S | | 12/1949 | Wertheimer |
| D164,453 | S | | 9/1951 | Scully |
| 2,926,360 | A | | 3/1960 | Erickson et al. |
| 3,075,203 | A | | 1/1963 | Stafford |
| D195,226 | S | | 5/1963 | Busillo |
| D213,726 | S | | 4/1969 | Lukas |
| 3,507,420 | A | | 4/1970 | Nelson et al. |
| 3,809,116 | A | | 5/1974 | Sanner |
| 3,922,733 | A | * | 12/1975 | Lyon ..... E03C 1/244 4/680 |
| 4,042,984 | A | | 8/1977 | Butler |
| D254,656 | S | | 4/1980 | Suwa |
| 4,258,444 | A | | 3/1981 | Orszullok |
| D291,419 | S | | 8/1987 | Linzer |
| D368,514 | S | | 4/1996 | Crepeau |
| D387,295 | S | | 12/1997 | Krikorian |
| D396,014 | S | | 7/1998 | Bigelow |
| 5,894,611 | A | | 4/1999 | Toro |
| D488,399 | S | | 4/2004 | Roszkowski |
| D556,615 | S | | 12/2007 | Sutherland |
| D627,037 | S | | 11/2010 | Glasser |
| D658,342 | S | | 4/2012 | Danak |
| D718,646 | S | | 12/2014 | Overmyer |
| D722,964 | S | | 2/2015 | Regole |
| D818,975 | S | | 5/2018 | Fournier |
| D832,124 | S | | 10/2018 | Lease |

(Continued)

*Primary Examiner* — Tuan N Nguyen
(74) *Attorney, Agent, or Firm* — Alvin T. Rockhill

(57) ABSTRACT

A bathtub safety device which prevents the water level in a bathtub from exceeding a desired level is described herein. This device is relatively simple and does not require a battery. This bathtub safety device is comprised of (1) a base section having a bathtub drain coupling which is adapted for insertion into a bathtub drain in a watertight manner and a vertically mounted water discharge tube having a water discharge slit, and (2) a water discharge adjustment ring having a series of water discharge holes which are arranged at different vertical heights and which are spaced apart radially along the circumference of the inside diameter of the water discharge adjustment ring, wherein the water discharge adjustment ring is positioned over the water discharge tube and is capable of being rotated radially on the water discharge tube.

20 Claims, 15 Drawing Sheets

(56) References Cited

U.S. PATENT DOCUMENTS

| | | | |
|---|---|---|---|
| D845,804 | S | 4/2019 | Williams |
| D883,812 | S | 5/2020 | Grillotti |
| D885,221 | S | 5/2020 | Huang |
| D886,654 | S | 6/2020 | Wada |
| D894,346 | S | 8/2020 | Brigham |
| 2007/0261300 | A1 | 11/2007 | Korte |
| 2014/0366266 | A1 | 12/2014 | Malaguit, Jr. |

* cited by examiner

BATHTUB SAFETY DEVICE

This application claims benefit of U.S. Provisional Patent Application Ser. No. 63/003,642, filed on Apr. 1, 2020. The teachings of U.S. Provisional Patent Application Ser. No. 63/003,642 are incorporated herein by reference in their entirety.

BACKGROUND OF THE INVENTION

Bath time is considered a great opportunity to create a bond between a parent and child, but it can be a dangerous time without proper adult supervision. While bathing a child, parents or caregivers can become easily distracted and turn away from the bathing child for a variety of reasons, such as answering the telephone or retrieving a towel, or even to attend to another child or a household chore. Losing their attention on the bathing child for even a short period of time can quickly lead to disaster. In fact, children needlessly die every year from drownings at home and two thirds of these children die in the bathtub. Infants under the age of one are most likely to drown in a bathtub. Experts warn that a child can drown in a matter of minutes and it can happen quickly and silently as a baby can slip under the water without crying or screaming or splashing around. In cases not resulting in death, the most severe cases of near drowning may lead to brain damage, memory problems, learning disabilities and permanent loss of basic functioning. It is needless to say that all of these cases are an absolute tragedy.

Automatic water level controls have been used for many years. Mechanical automatic water controls for bathtubs are known, one such control system being described, for example, in U.S. Pat. No. 2,180,790. The general object of the device described in U.S. Pat. No. 2,180,790 is to provide an adjustable means for regulating the level and temperature of the water in the tub by manipulating handles or knobs to fill the tub to any desired water level and temperature by employing an electric means. This device opens and shuts a drain and starts the flow of water into the tub when the drain is closed. Other patents relating to automatic water control levels include U.S. Pat. Nos. 1,820,981, 2,926,360, 3,507,420, 3,809,116, and 4,042,984. These devices are generally complex and are typically large, bulky, and made of materials that can be rough and inappropriate for contact with the delicate skin of a baby.

Another common type of bathtub safety product is a water level control system that generates an audible alarm or signal immediately when water comes into contact with the device, preventing a dangerous situation when bathing children. U.S. Pat. No. 4,258,444 discloses a bath water level control system of this type for use with bathtubs that includes a capacitive proximity switch disposed external to one wall of the bathtub that generates a signal when the water level is approximately at the level of the switch. The bathtub water level control system of U.S. Pat. No. 4,258,444 is more specifically comprised of: a vertically adjustable detecting means disposed exterior to one wall of said tub for generating a signal when the water in said tub reaches a level at approximately the level of said detecting means; a means for vertically positioning said detecting means, said positioning means including means for holding said detecting means and for translating movement of said level selecting means into a corresponding vertical movement of said detecting means, said holding means comprising a threaded spindle rotatably mounted adjacent said one wall of said tub and a nut supported on said spindle, said nut being nonrotatably connected to said detecting means; said bathtub including an overflow aperture and a cover rosette; said system further comprising: a level selecting means comprising a knob movable on said rosette, gearing means coupling said knob to said spindle, means for mounting said spindle to permit rotational movement thereof; and a means responsive to said generated signal for shutting off the inflowing water supply.

U.S. Pat. No. 5,894,611 also discloses a device that generates an audible alarm after a predetermined water level is reached. The device described in U.S. Pat. No. 5,894,611 is designed to remotely indicate the attainment of a predetermined level of water in a bath tub, said device comprising: a waterproof housing possessing a hollow interior, a lower housing portion having at least one aperture therethrough covered by a flexible membrane, and an upper housing portion having one at least one aperture therethrough covered by a vibrating membrane; attachment means for attaching said waterproof housing to an interior surface of a bath tub possessing the capability of maintaining said housing in an immobile position with respect to said interior surface of said bath tub; an electrical circuit enclosed inside said housing interior electrically connecting a power supply comprising at least one battery enclosed within said interior of said housing, an annunciator, an upper fixed contact, and a lower moving contact attached to an interior surface of said flexible membrane; said annunciator having the capability of sounding an alarm exteriorally of said housing utilizing said vibrating membrane when said electrical circuit is completed; said flexible membrane possessing a seal with said lower portion of said housing about one said aperture therethrough and sufficient flexibility to be pressed by a rising water level from a dependent position to an upward position whereby said lower moving contact is pressed against said upper fixed contact thereby completing said electrical circuit and causing said annunciator to sound an alarm.

The problems with systems that produce an audible alarm include the possibility of the parent or caregiver not being able to hear the alarm if they are hard of hearing or not in close enough proximity to the alarm, such as being in another room or outside of the house. The sound of the alarm can also be masked by loud music or simply not heard by virtue of being preoccupied by a television program or some other type of distraction. Furthermore, devices of this type require electrical circuitry and a power supply which add to cost and complexity. More importantly, devices which require electrical circuits are susceptible to failure and may malfunction at a critical moment resulting in disaster. In another scenario devices that rely on batteries may simply not be available for use utilization at critical times due to dead batteries.

Other methods used by parents to bathe children in the bathtub include the use of bathtub seats and rings. Bathtub seats are utilized to keep babies supported and in place while bathing. U.S. Pat. No. 10,568,465 describes bath seats that are adapted to mount in a bathtub and hold a young child or baby in a secure position for bathing. U.S. Pat. Nos. 2,645,781, 5,010,606, 5,687,433, 7,065,805, and 9,655,477 all describe child bath seats. Bathtub rings are used to prevent slippery babies from toppling under the water by keeping them in an upright position. U.S. Pat. No. 5,588,158 discloses a bath ring for supporting an infant. U.S. Pat. Nos. 5,317,765 and 9,326,641 also disclose bath rings.

Bathtub seats and rings, however, have been found to play a role in the increasing number of infant drowning deaths. Many parents purchased baby bath seats with the idea that the baby would be safer being strapped into the seat in the tub. Some experts believe, however, that the use of bath seats can be dangerous. The use of such products may increase the risk of drowning among infants by giving parents a false sense of security, increasing the likelihood that an infant will be left alone in the tub. In fact, the U.S. Consumer Product Safety Commission no longer recommends baby bath seats due to the propensity for children to slip out of them or tip them over which can result in being trapped with their heads under water while being strapped in the seat and unable to sit up. Also, bathtub seats and rings are only useful for a short period of time as the child can quickly outgrow the product.

Parents have long been searching for a product that makes bath time less dangerous for a child by maintaining a safe water level to reduce the risk of drowning while still leaving an adequate amount of water to properly and thoroughly bathe the child. Such a product would preferably also not be too large in size as to impede the already small area of most bathtubs to leave sufficient room in the bathtub for the child to splash and play. It is also desirable for such a product to be simple, inexpensive, durable, free of electrical circuitry, failsafe in operation, and capable of adjustment to the size and age of the child.

SUMMARY OF THE INVENTION

The present invention provides a bathtub safety device which prevents the water level in a bathtub from exceeding a desired level. This desired maximum water level can be easily adjusted as needed to accommodate particular needs, such as the size and age of a child or an elderly person. It is also of a relatively simple design which is durable and which is free of electrical circuitry (does not require a battery). Accordingly, this device cannot fail as the result of an electrical failure or a dead battery. As an important safety feature this device causes the tub to drain if it becomes detached from the bathtub drain.

The design of this device also allows for it to be used in a typical bathtub without being particularly intrusive. In other words, it does not occupy a significant volume of the bathtub and can be positioned in a manner whereby it does not interfere with typical bathing and play in the bathtub. It is also adapted for use in virtually any bathtub without the need for any type of modification or retrofitting. In other words, it can normally be used in almost all bathtubs "right out of the box."

The subject invention more specifically discloses a bathtub safety device which is comprised of (1) a base section having a bathtub drain coupling which is adapted for insertion into a bathtub drain in a watertight manner and a vertically mounted water discharge tube having a water discharge slit, and (2) a water discharge adjustment ring having a series of water discharge holes which are arranged at different vertical heights and which are spaced apart radially along the circumference of the inside diameter of the water discharge adjustment ring, wherein the water discharge adjustment ring is positioned over the water discharge tube and is capable of being rotated radially on the water discharge tube.

The present invention further reveals a method for maintaining a desired water level in a bathtub which comprises (1) connecting the bathtub safety device to a bathtub by inserting the bathtub drain coupling of the bathtub safety device into the bathtub drain in a watertight manner, and (2) filling the bathtub with water. The desired water level can then be set by rotating the water discharge adjustment ring of the bathtub safety device.

Figure 1:
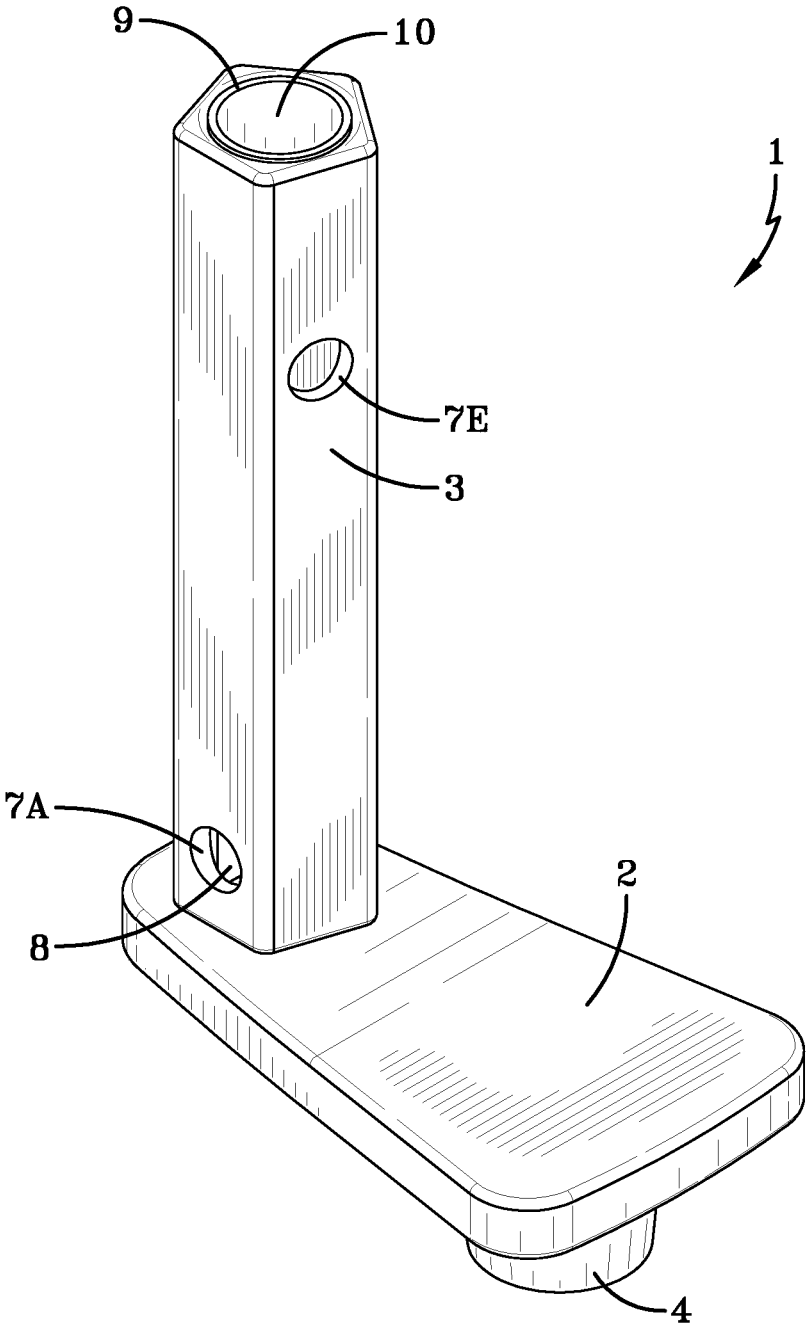
FIG. 1 is a front perspective view of the bathtub safety device of this invention.

The reference numerals used in the drawings to identify the elements of the bathtub safety device of this invention are as follows:

1 bathtub safety device
2 base section
3 water discharge adjustment ring
4 drain coupling
5 bathtub
6 bathtub drain
7A water discharge holes on side A of the water discharge adjustment ring (lowest water discharge hole).
7B water discharge holes on side B of the water discharge adjustment ring
7C water discharge holes on side C of the water discharge adjustment ring
7D water discharge holes on side D of the water discharge adjustment ring
7E water discharge holes on side E of the water discharge adjustment ring (highest water discharge hole)
8 water discharge slit
9 water discharge tube
10 top opening of water discharge tube

DETAILED DESCRIPTION OF THE INVENTION

Figure 2:
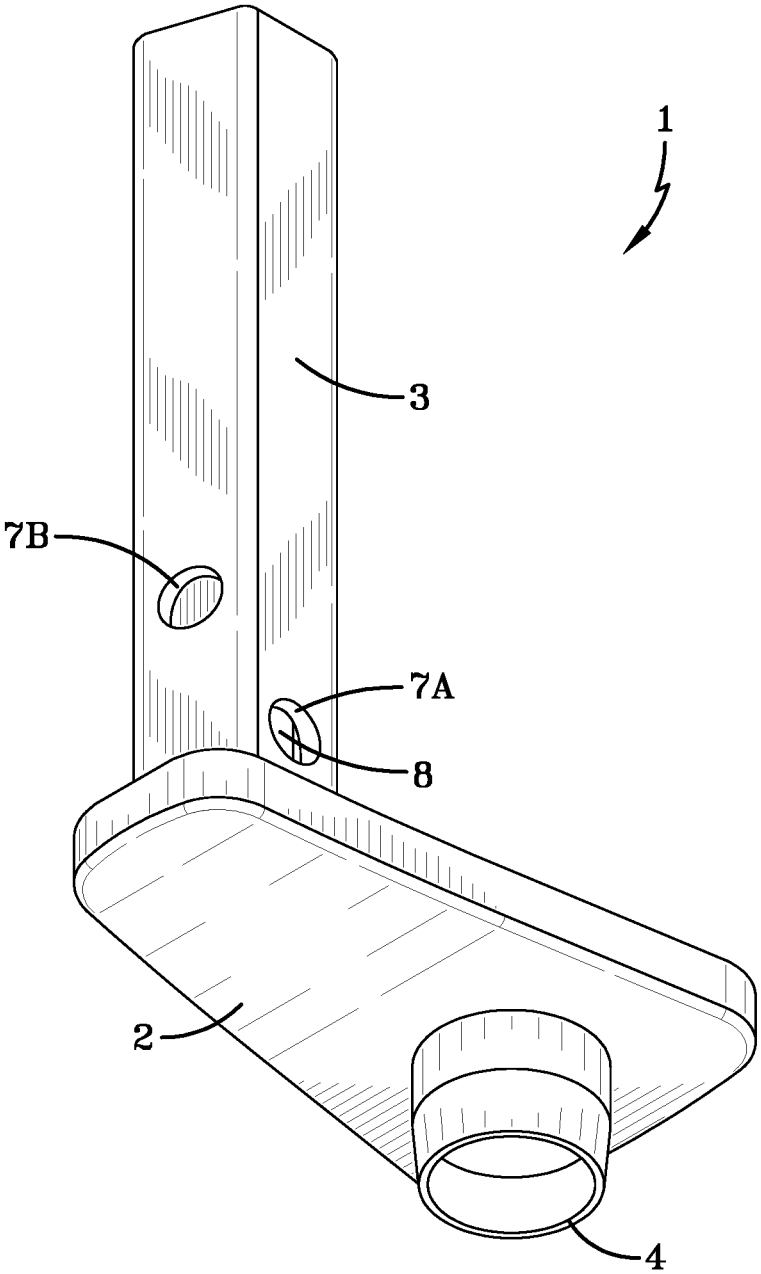
FIG. 2 is a bottom perspective view of the bathtub safety device of this invention.
Figure 3:
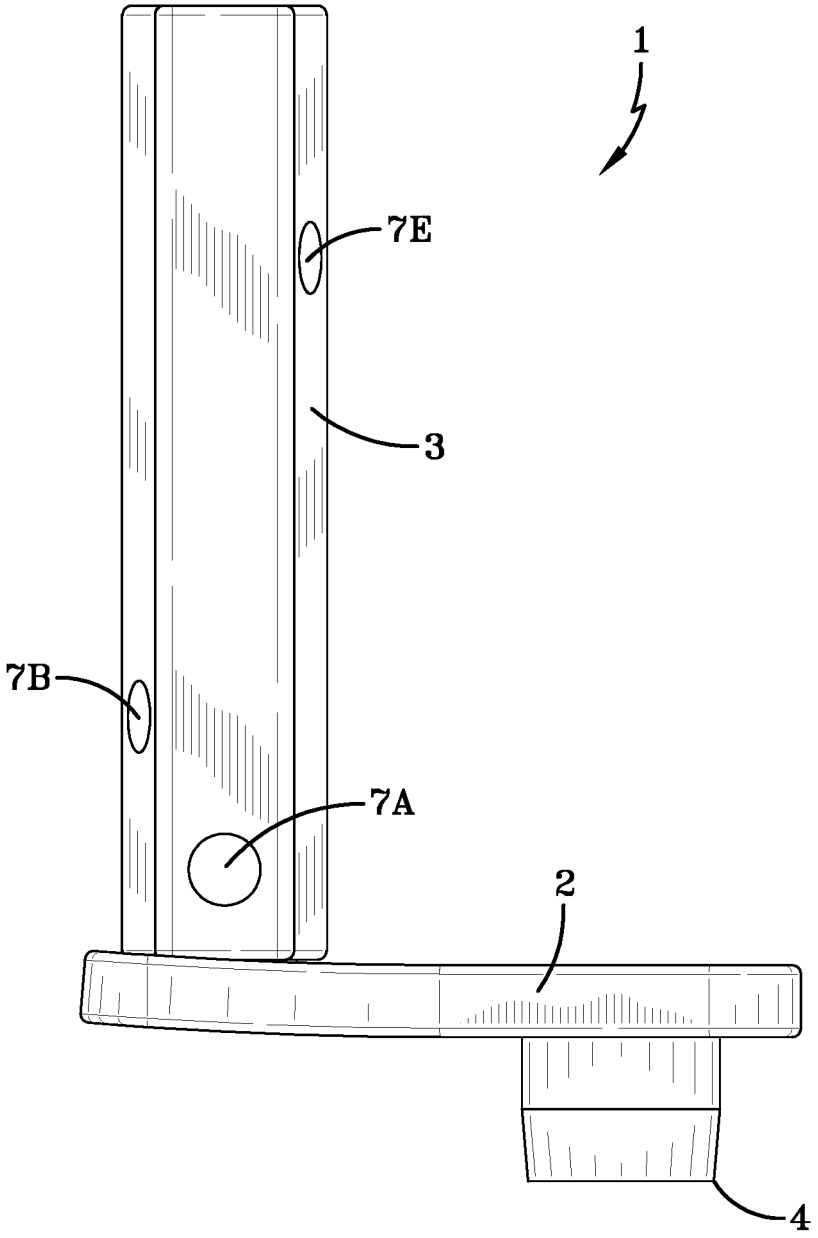
FIG. 3 is a left side view of the bathtub safety device of this invention.
Figure 4:
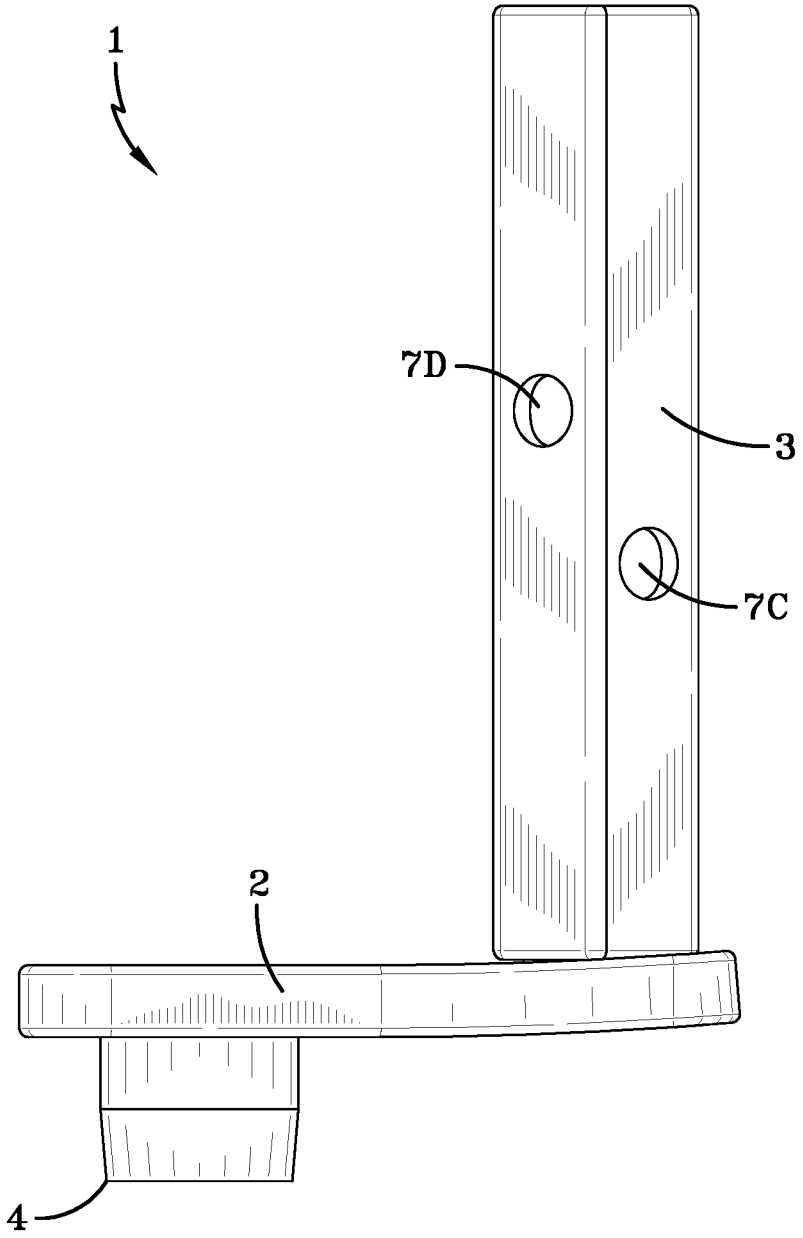
FIG. 4 is a right side view of the bathtub safety device of this invention.
Figure 5:
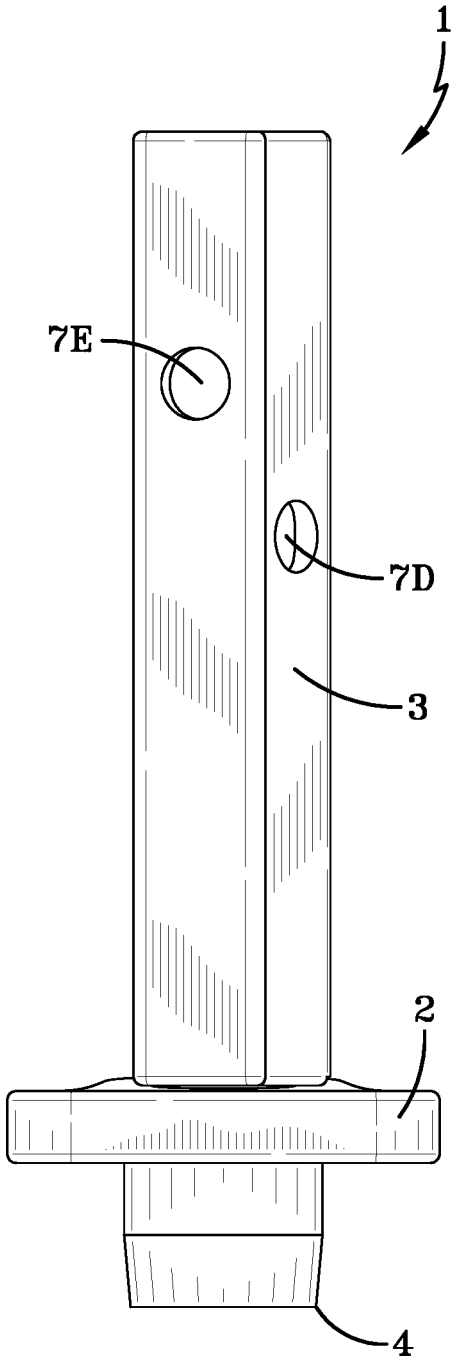
FIG. 5 is a front view of the bathtub safety device of this invention.
Figure 6:
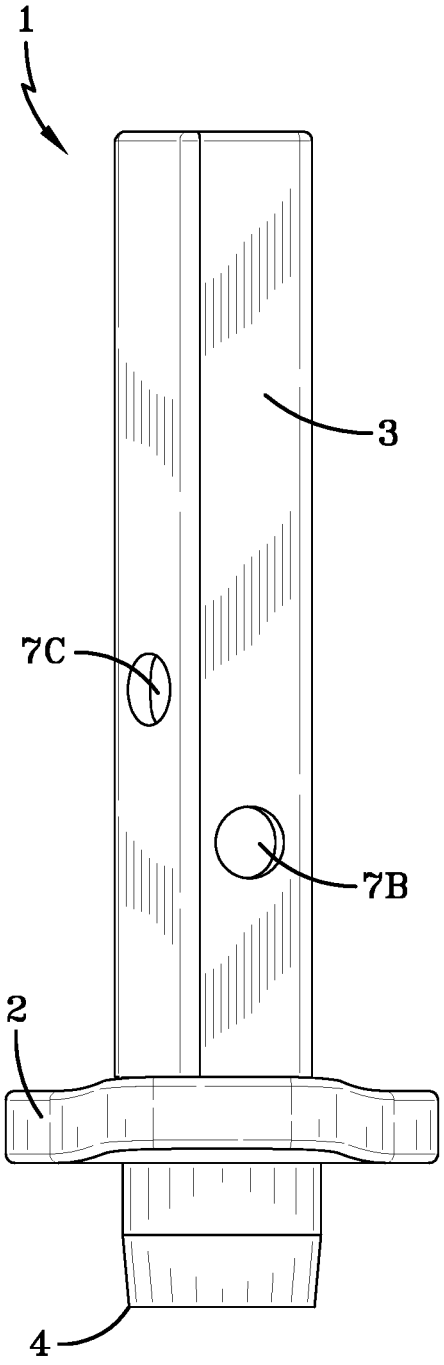
FIG. 6 is a back view of the bathtub safety device of this invention.
Figure 7:
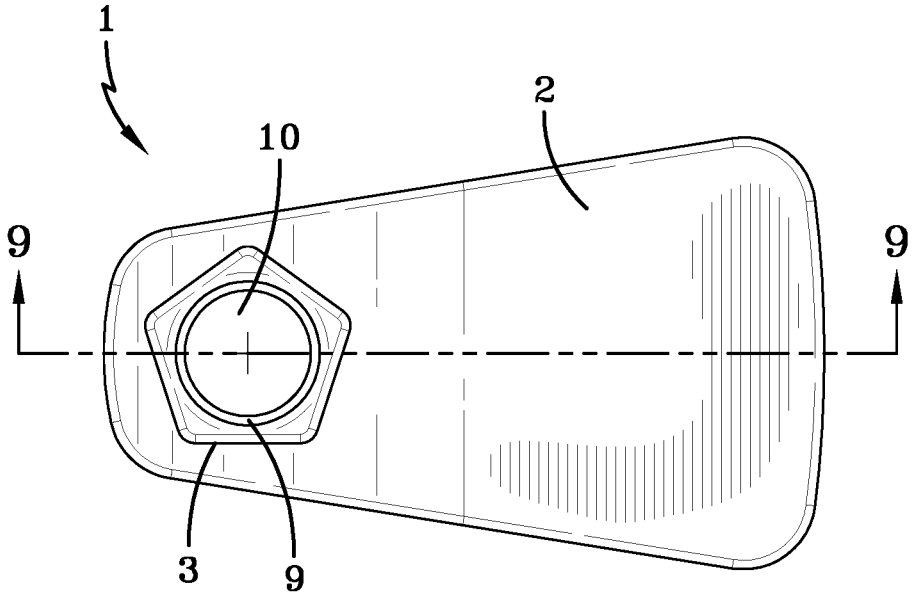
FIG. 7 is a top view of the bathtub safety device of this invention.
Figure 8:
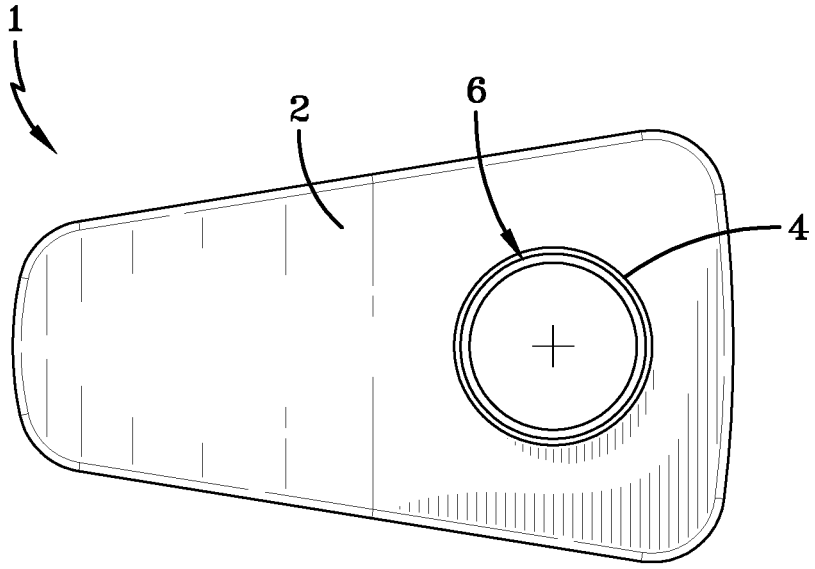
FIG. 8 is a bottom view of the bathtub safety device of this invention.

The bathtub safety device of this invention 1 is comprised of a base section 2 and a water discharge adjustment ring 3 as illustrated in FIG. 1 and FIG. 2. The base section 2 includes a bathtub drain coupling 4 which is adapted for insertion into a bathtub drain in a watertight manner. The bathtub drain coupling 4 is typically pipe section of a size which allows for it to be inserted snuggly into a bathtub drain in a manner that creates a water tight seal. In other words, the bathtub drain coupling 4 will have an outside diameter which is approximately the diameter of the inside diameter of the bathtub drain of the bathtub on which it will be used. In the case of most standard bathtubs the outside diameter will be approximately 1⅜ inch (3.5 cm). The length of the drain coupling 4 will typically be from about ⅝ inch (1.6 cm) to about 1¼ inch (3.2 cm) and will normally be within the range of ¾ inch (1.9 cm) to about 1 inch (2.5 cm). In many cases, the drain coupling 4 will be about ⅞ inch (2.2 cm) long which is normally long enough to attain a tight seal against the bathtub drain pipe without being too long to be accommodated in the bathtub drain. It is, of course, also important for the drain coupling 4 to be of large enough to firmly secure the bathtub safety device 1 to the bathtub so that it does not because easily dislodged from the bathtub while in use.

The bathtub safety device 1 can be installed on a bathtub 5 by inserting the drain coupling 4 securely into the drain of the bathtub (bathtub drain) 6 so as to make a water tight seal. The maximum water level to which the bathtub is capable of being filled can then be set by rotating the water discharge adjustment ring 3 so as to align the appropriate water discharge hole 7A, 7B, 7C, 7D, or 7E which is at the desired water level with the water discharge slit 8 on the vertically mounted water discharge tube 9. As can be seen in FIG. 11A, FIG. 11B, FIG. 11C, FIG. 11D, and FIG. 11E the water discharge holes 7A, 7B, 7C, 7D, and 7E are arranged at different vertical heights and are spaced apart radially along the circumference of the inside diameter of the water discharge adjustment ring 3. More specifically, water discharge holes 7A, 7B, 7C, 7D, and 7E are positioned at higher and higher levels on sides A, B, C, D, and E, respectively, of the water discharge adjustment ring 3. For instance, the water discharge holes can be spaced apart at a vertical increment of about 1 inch (2.5 cm) from each other. In this manner a maximum water level of about 1 inch (2.5 cm), 2 inches (5.1 cm), 3 inches (7.6 cm), 4 inches (10.2 cm), or 5 inches (12.7 cm) could be set by rotating the water discharge adjustment ring 3 to align water discharge hole 7A, 7B, 7C, 7D, or 7E, respectively, with the water discharge slit 8 on the vertically mounted water discharge tube 9. The water discharge holes 7A, 7B, 7C, 7D, and 7E on the water discharge adjustment ring 3 typically have a diameter which is within the range of about ⅜ inch (1.0 cm) to about ⅝ inch (1.6 cm) and normally have a diameter of about ½ inch (1.3 cm). The water discharge slit 8 extends upwardly on the water discharge tube 9 from a height that aligns it with the lowest water discharge hole 11A on the water discharge adjustment ring 3 and extends upwardly to a point that aligns it with the highest water discharge hole 11E on the water discharge adjustment ring 3.

In the design depicted in FIG. 1, FIG. 2, FIG. 3, FIG. 4, FIG. 5, FIG. 6, FIG. 7, FIG. 10, FIG. 11A, FIG. 11B, FIG. 11C, FIG. 11D, FIG. 11E, FIG. 14, and FIG. 15 the water discharge adjustment ring 3 has 5 outer sides of equal length (is of a regular pentagonal shape). However, it should be noted that the water discharge adjustment ring 3 can also be circular or of some other shape, such as square, a regular hexagon, a regular heptagon, a regular octagon, or a regular polygon with even more sides of equal length.

Figure 9:
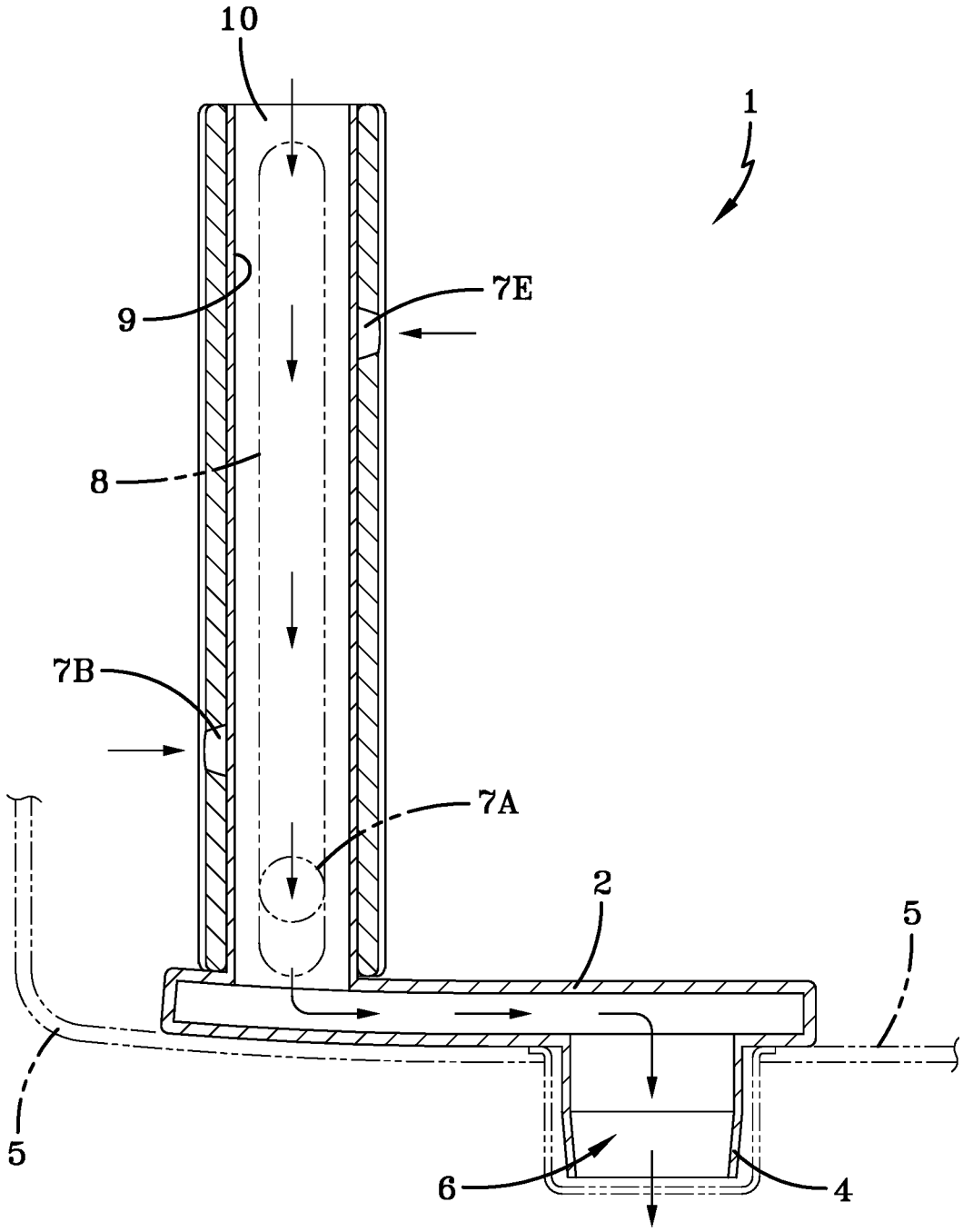
FIG. 9 is a cross-sectional view of the bathtub safety device of this invention which illustrates various paths through which water can flow through the device.
Figure 10:
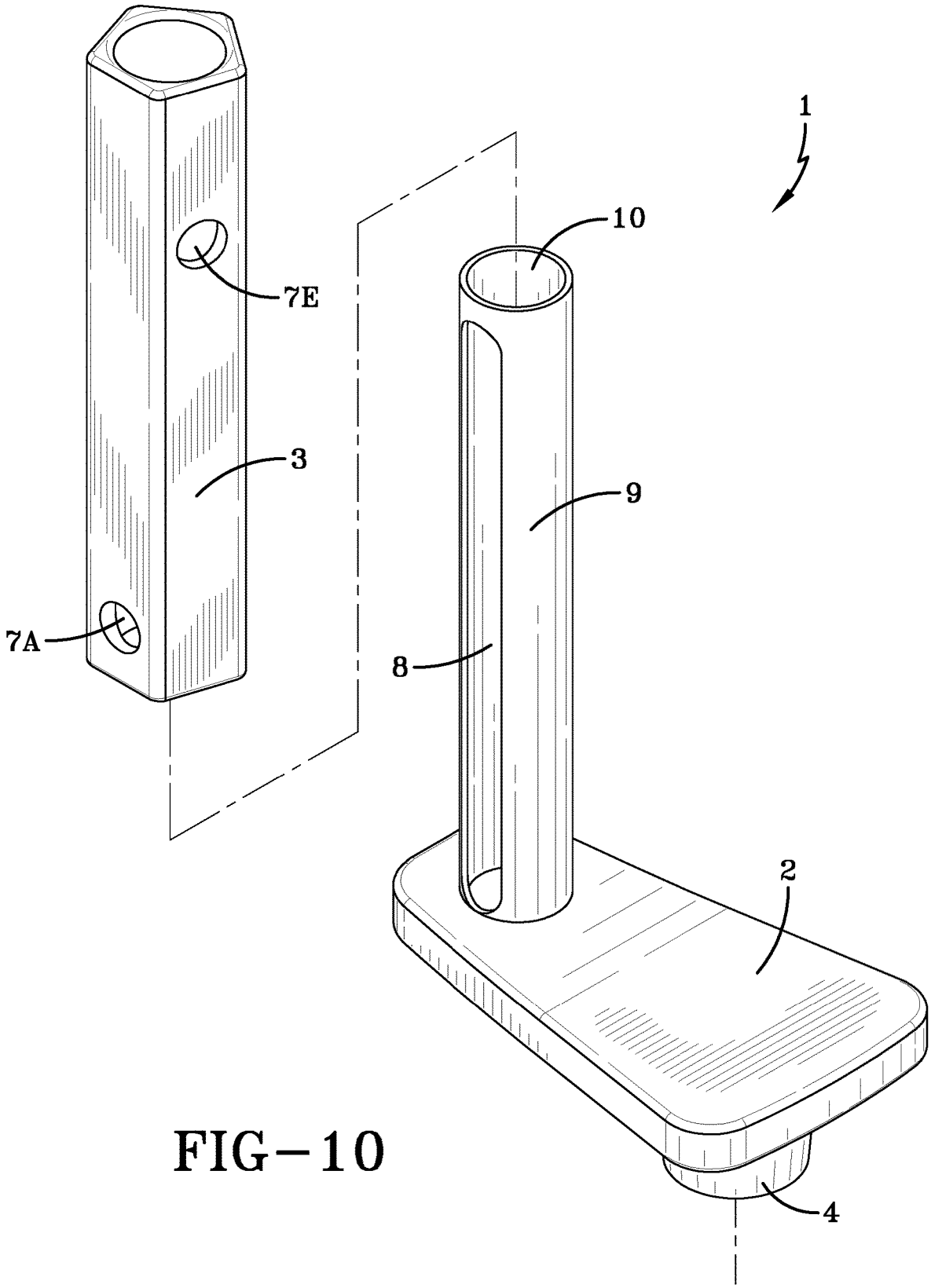
FIG. 10 is an exploded view of the bathtub safety device of this invention which illustrates the water discharge adjustment ring as being detached from the base section.
Figure 11A:
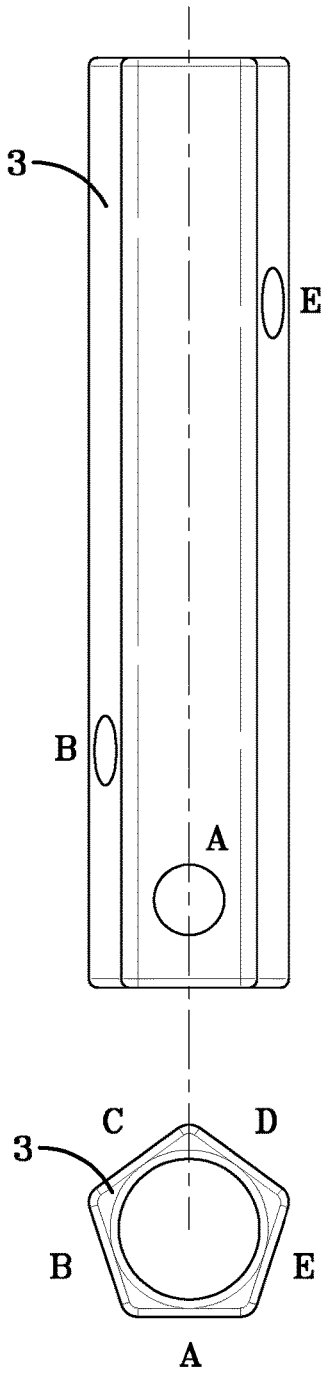
FIG. 11A is a view taken from side A (the front) of the water discharge ring of the bathtub safety device of this invention.
Figure 11B:
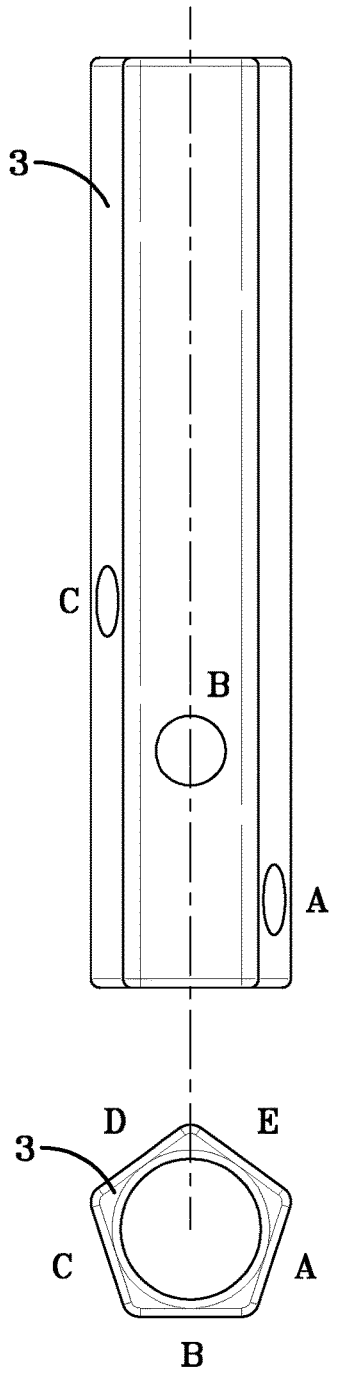
FIG. 11B is a view taken from side B (the left front side) of the water discharge ring of the bathtub safety device of this invention.
Figure 11C:
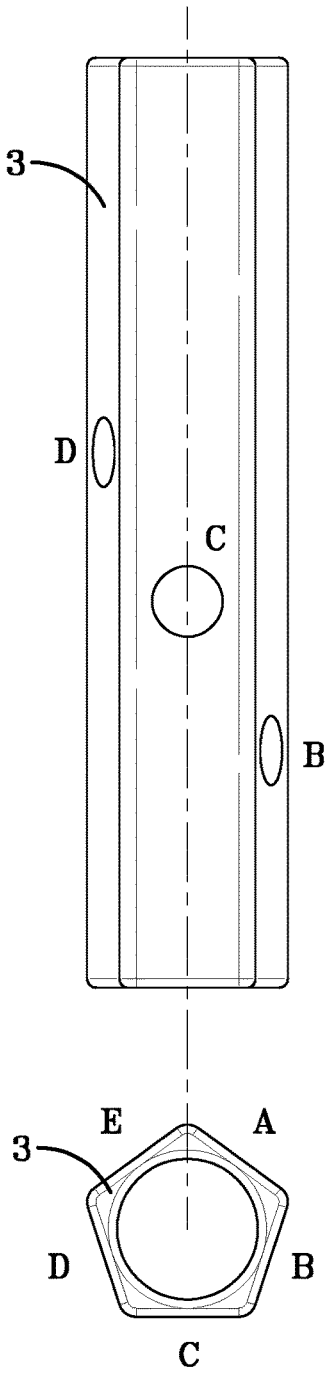
FIG. 11C is a view taken from side C (the left back side) of the water discharge ring of the bathtub safety device of this invention.
Figure 11D:
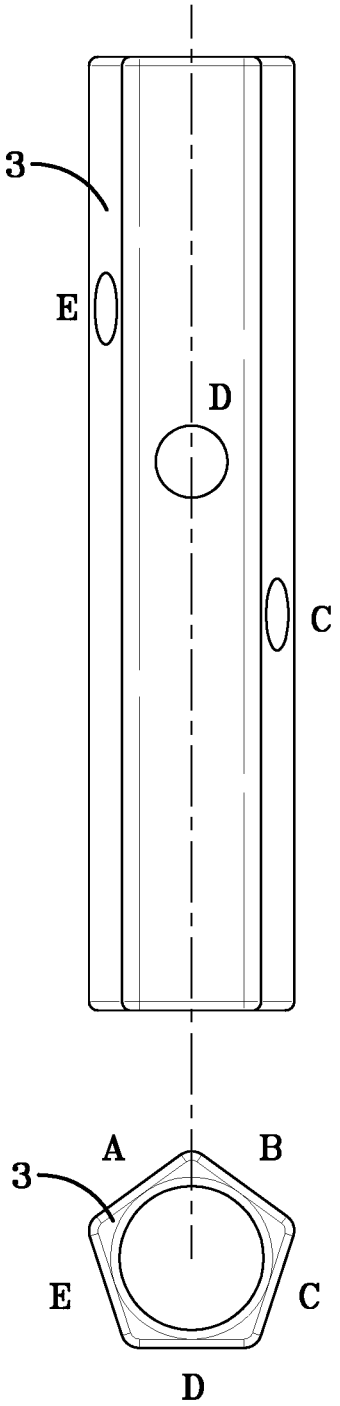
FIG. 11D is a view taken from side D (the right back side) of the water discharge ring of the bathtub safety device of this invention.
Figure 11E:
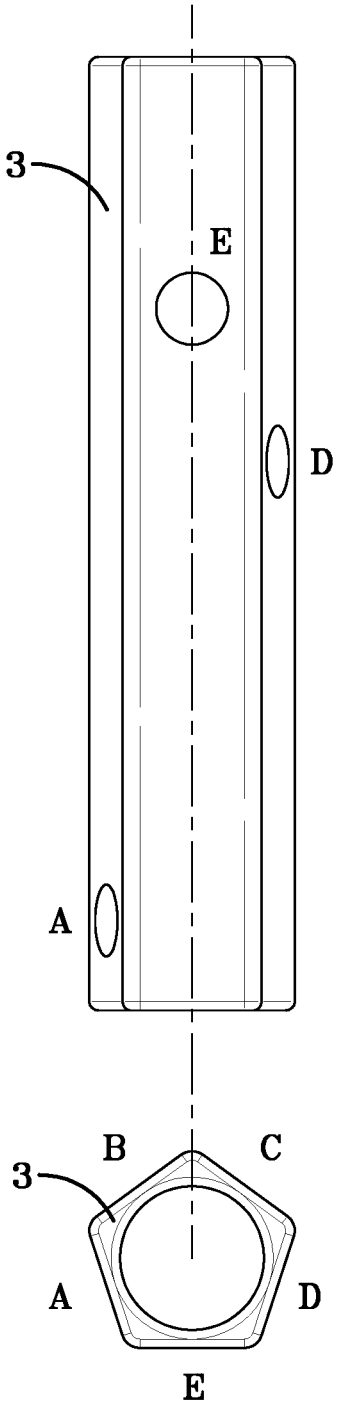
FIG. 11E is a view taken from side E (the right front side) of the water discharge ring of the bathtub safety device of this invention.
Figure 12:
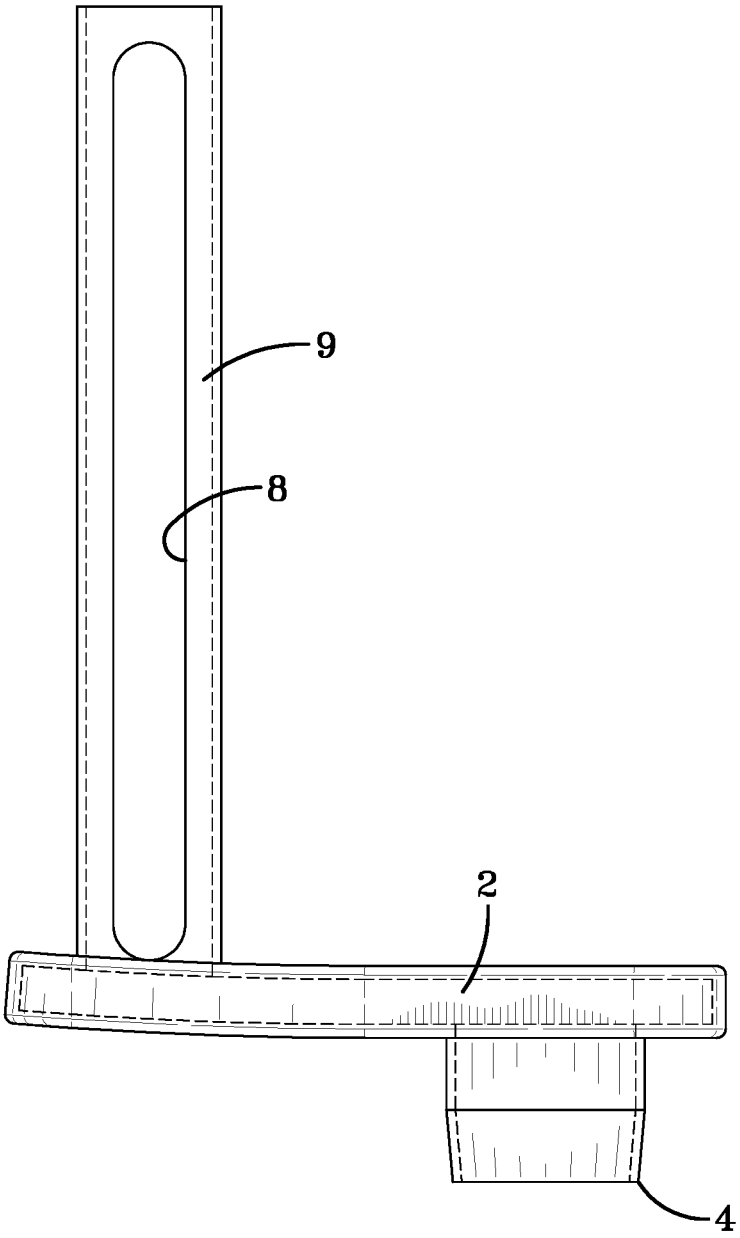
FIG. 12 is left side view of the base section the bathtub safety device of this invention with the water discharge adjustment ring being detached therefrom to better illustrate the water discharge slit on the vertically mounted water discharge tube.
Figure 13:
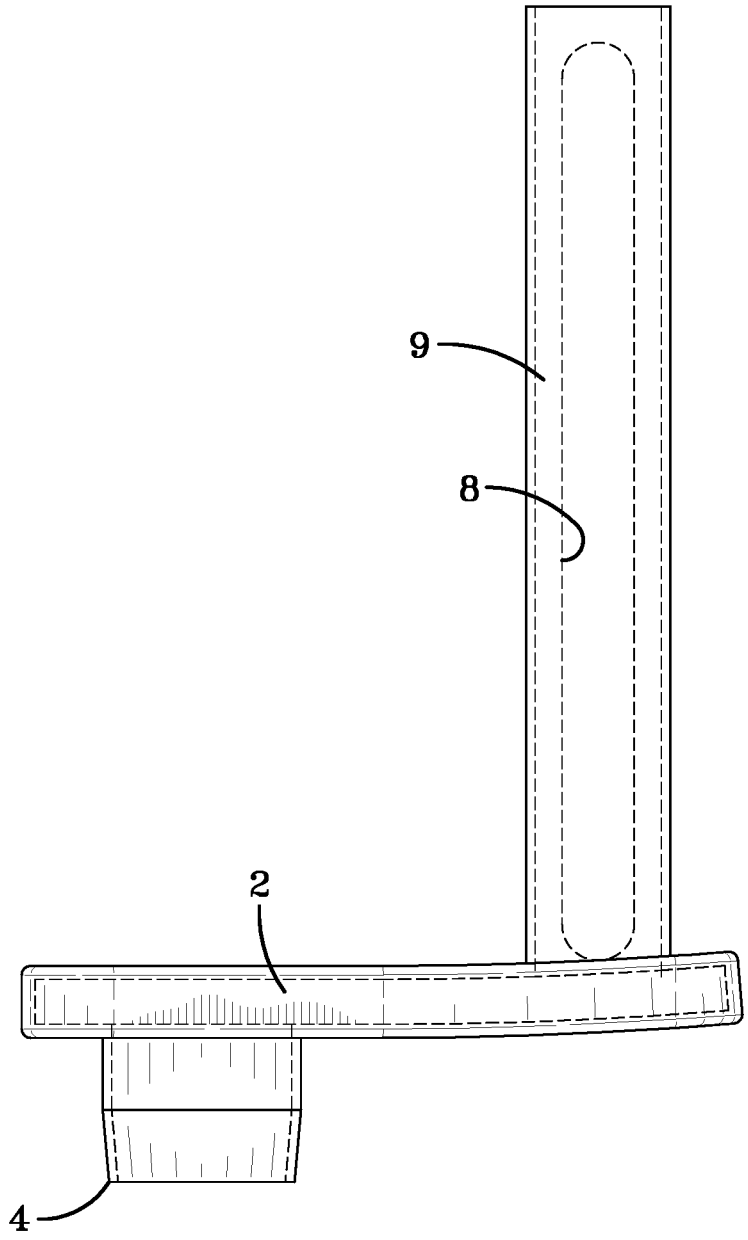
FIG. 13 is right side cut away view of the base section the bathtub safety device of this invention with the water discharge adjustment ring being detached therefrom which illustrates the water discharge slit on the left side of the vertically mounted water discharge tube.
Figure 14:
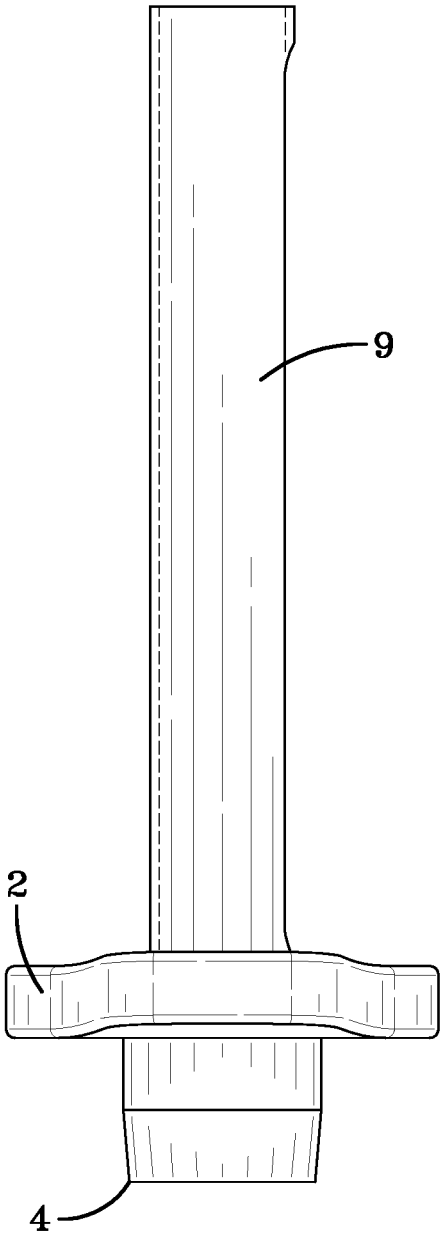
FIG. 14 is back view of the base section the bathtub safety device of this invention with the water discharge adjustment ring being detached therefrom.
Figure 15:
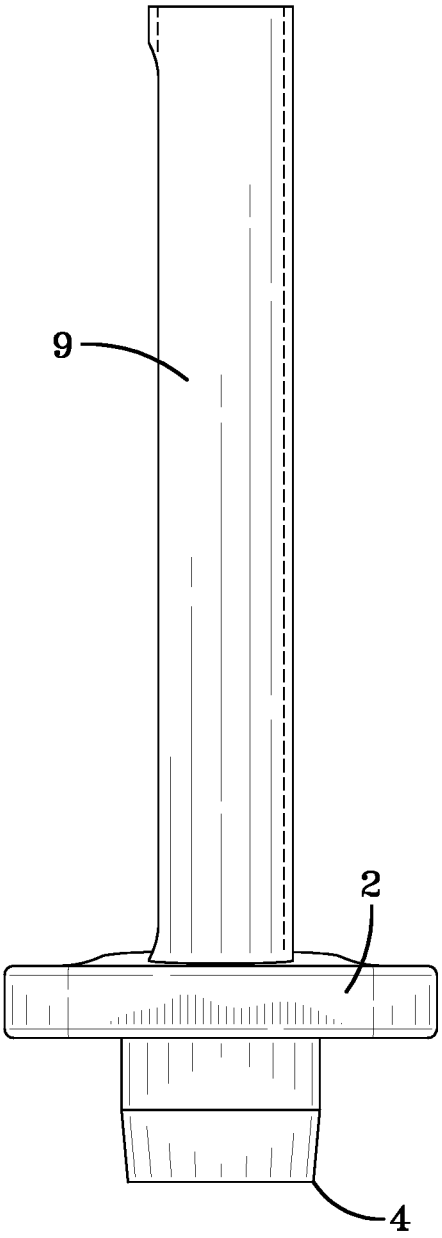
FIG. 15 is front view of the base section the bathtub safety device of this invention with the water discharge adjustment ring being detached therefrom.
Figure 16:
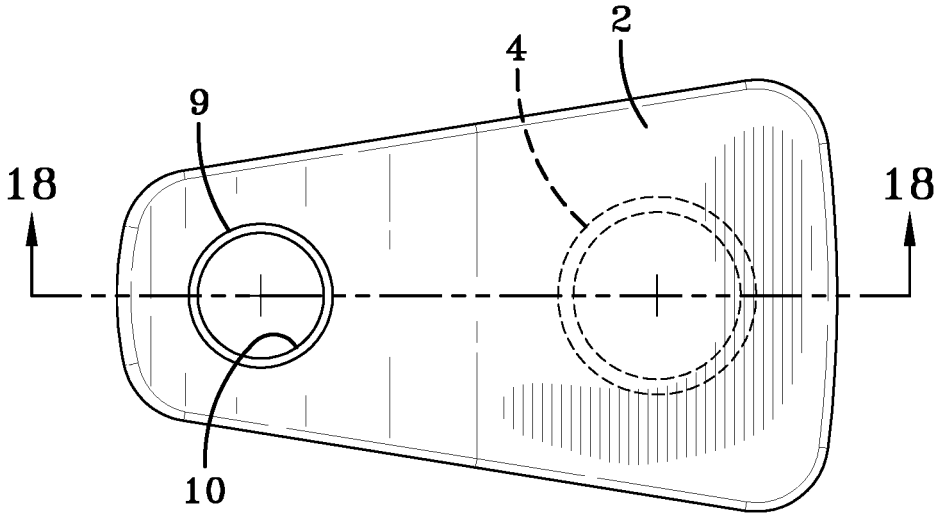
FIG. 16 is top view of the base section the bathtub safety device of this invention with the water discharge adjustment ring being detached.
Figure 17:
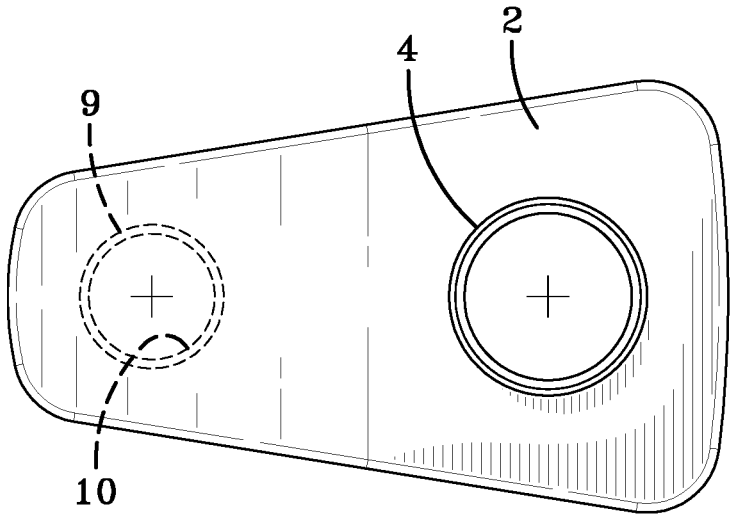
FIG. 17 is bottom view of the base section the bathtub safety device of this invention with the water discharge adjustment ring being detached.
Figure 18:
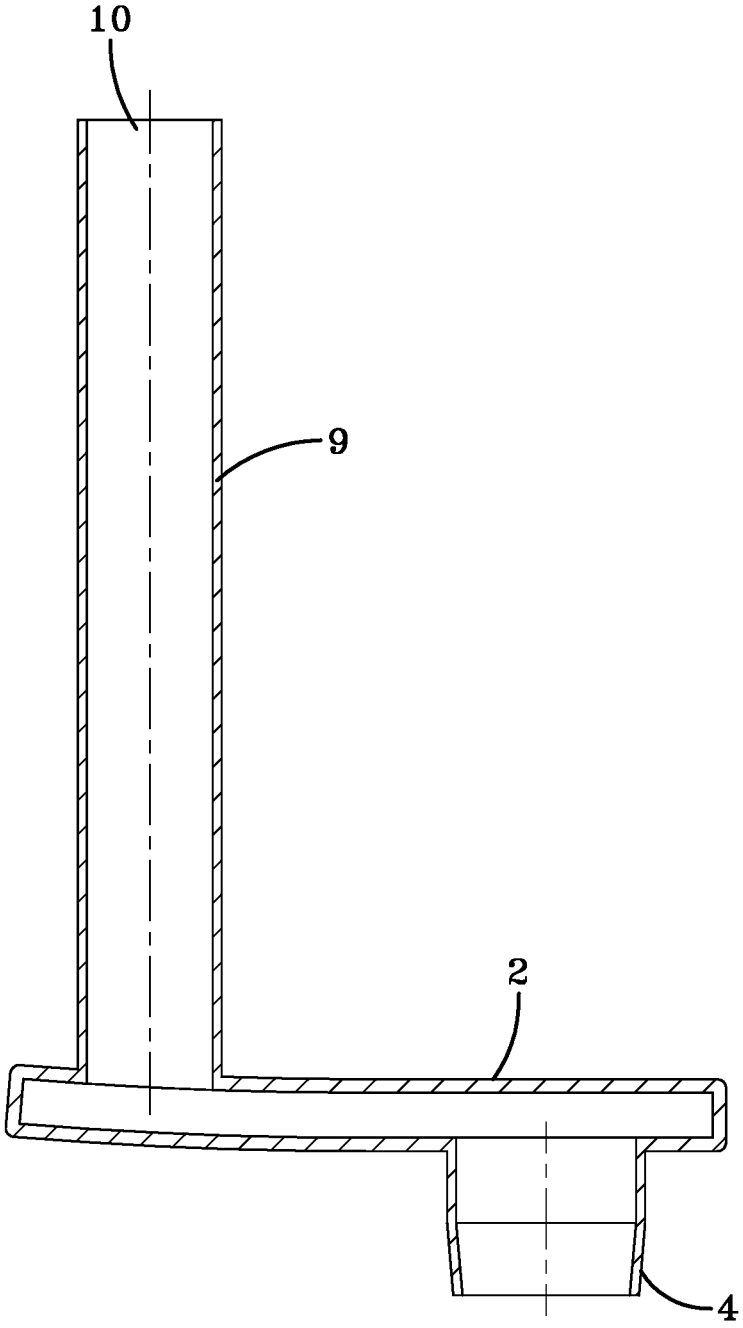
FIG. 18 is cross-sectional view of the base section the bathtub safety device of this invention with the water discharge adjustment ring being detached as taken along line 18-18 of FIG. 16.

The water discharge tube 9 will generally have an inside diameter which is within the range of about ¾ inch (1.9 cm) to about 1 inch (2.5 cm), such as an inside diameter of about ⅞ inch (2.2 cm). It should be noted that the water discharge tube 9 preferably has a top opening 10 through which water can flow in the event that water is flowing into the bathtub at an excessive rate or in the event that one or more of the discharge holes 7A, 7B, 7C, 7D, or 7E are blocked or become clogged. Such a water flow is illustrated in FIG. 9 wherein the water flow (depicted by arrows) enters the water discharge tube 9 through the top opening 10. Under conditions of normal operation water would flow through a water discharge hole 7A, 7B, 7C, 7D, or 7E and into the water discharge tube 9 through the water discharge slit 8. In the design illustrated the water then flows through a horizontal flow area 11 which connects water discharge tube 9 to the drain coupling 4. This design allows the vertically oriented water discharge tube 9 and the water discharge adjustment ring 4 to be positioned into a less intrusive area of the bathtub (near the bathtub wall). In the design illustrated the discharge tube 9 and the water discharge adjustment ring 4 are typically horizontally offset from the drain coupling 4 by about 2 inches (5.1 cm) to about 3 inches (7.6 cm), such as by about 2.5 inches (6.4 cm).

While certain representative embodiments and details have been shown for the purpose of illustrating the subject invention, it will be apparent to those skilled in this art that various changes and modifications can be made therein without departing from the scope of the subject invention.

What is claimed is:

1. A bathtub safety device which is comprised of (1) a base section having a bathtub drain coupling which is adapted for insertion into a bathtub drain in a watertight manner, a horizontal flow area which is situated between the water discharge tube and the drain coupling which connects the water discharge tube to the drain coupling and which offsets the discharge tube from the drain coupling by about 2 inches to about 3 inches, and a vertically mounted water discharge tube having a water discharge slit, and (2) a water discharge adjustment ring having a series of water discharge holes which are arranged at different vertical heights and which are spaced apart radially along the circumference of the inside diameter of the water discharge adjustment ring, wherein the water discharge adjustment ring is positioned over the water discharge tube and is capable of being rotated radially on the water discharge tube.

2. The bathtub safety device as specified in claim 1 wherein the water discharge slit extends upwardly from a height that aligns it with the lowest water discharge hole on the water discharge adjustment ring and extends upwardly to a point that aligns it with the highest water discharge hole on the water discharge adjustment ring.

3. The bathtub safety device as specified in claim 1 wherein the water discharge holes on the water discharge adjustment ring have a diameter which is within the range of about ⅜ inch to about ⅝ inch.

4. The bathtub safety device as specified in claim 1 wherein the water discharge holes on the water discharge adjustment ring have a diameter of about ½ inch.

5. The bathtub safety device as specified in claim 1 wherein the series of water discharge holes includes at least 4 water discharge holes.

6. The bathtub safety device as specified in claim 1 wherein the bathtub safety device has 4 water discharge holes.

7. The bathtub safety device as specified in claim 1 wherein the bathtub safety device has 5 water discharge holes.

8. The bathtub safety device as specified in claim 1 wherein the bathtub safety device has 6 water discharge holes.

9. The bathtub safety device as specified in claim 7 wherein the water discharge adjustment ring is of a regular pentagonal design.

10. The bathtub safety device as specified in claim 8 wherein the water discharge adjustment ring is of a regular hexagonal design.

11. The bathtub safety device as specified in claim 8 wherein the water discharge adjustment ring is of a regular polygonal design.

12. The bathtub safety device as specified in claim 1 wherein the horizontal flow area offsets the discharge tube from the drain coupling about 2.5 inches.

13. The bathtub safety device as specified in claim 1 wherein the water discharge holes are spaced apart at a vertical increment of about 1 inch from each other.

14. The bathtub safety device as specified in claim 13 wherein the water discharge tube has a top opening which has a diameter which is the same as the inside diameter of the water discharge tube.

15. The bathtub safety device as specified in claim 1 wherein the water discharge tube includes a top opening.

16. The bathtub safety device as specified in claim 1 wherein the discharge tube has a diameter which is within the range of about ¾ inch to about 1 inch.

17. A method for maintaining a desired water level in a bathtub which comprises (1) connecting the bathtub safety device of claim 1 to a bathtub drain in a single step which consists of inserting the bathtub drain coupling of the bathtub safety device into the bathtub drain in a watertight manner, and (2) filling the bathtub with water.

18. The method of claim 17 wherein the desired water level is set by rotating the water discharge adjustment ring of the bathtub safety device.

19. The method of claim 18 wherein the series of water discharge holes includes at least 4 water discharge holes, and wherein the water discharge adjustment ring is of a regular pentagonal design or regular hexagonal design.

20. The bathtub safety device as specified in claim 1 wherein the bathtub drain coupling is the lowest component of the bathtub safety device.

* * * * *